United States Patent [19]

Taumann

[11] 4,427,890

[45] Jan. 24, 1984

[54] DOSE MONITOR CHAMBER FOR ELECTRON OR X-RAY RADIATION

[75] Inventor: Leonhard Taumann, Lafayette, Calif.

[73] Assignee: Siemens Medical Laboratories, Inc., Walnut Creek, Calif.

[21] Appl. No.: 289,137

[22] Filed: Aug. 3, 1981

[51] Int. Cl.[3] ..... H01J 47/02

[52] U.S. Cl. ..... 250/385; 250/397

[58] Field of Search ..... 250/385, 374, 397, 389

[56] References Cited

U.S. PATENT DOCUMENTS

| | | | |
|---|---|---|---|
| 3,808,441 | 4/1974 | Boux | 250/397 |
| 3,852,610 | 12/1974 | McIntyre | 250/385 |
| 3,942,012 | 3/1976 | Boux | 250/385 |
| 4,131,799 | 12/1978 | Stieber | 250/385 |
| 4,347,547 | 8/1982 | Gibson | 250/385 |

FOREIGN PATENT DOCUMENTS 2215701 8/1974 France .

1598962 9/1981 United Kingdom .

*Primary Examiner*—Alfred E. Smith
*Assistant Examiner*—Carolyn E. Fields
*Attorney, Agent, or Firm*—Karl F. Milde, Jr.

[57] ABSTRACT

The chamber contains a first and a second measuring electrode and a third electrode. The first measuring electrode is essentially a first flat ring portion. The second measuring electrode comprises an inner circular area to the periphery of which a second flat ring portion adjoins in an electrically conducting manner. The first and the second measuring electrodes are arranged in a first plane. The first and the second ring portion are combined approximately 360°. The third electrode is arranged in a second plane parallel to and spaced from the first plane. When ionizing radiation (X-rays, electrons) enters the space between the first and second measuring electrodes on the one side and the third electrode on the other side, electrical signals will be derived from said respective first and second electrode.

9 Claims, 5 Drawing Figures

DOSE MONITOR CHAMBER FOR ELECTRON OR X-RAY RADIATION

BACKGROUND OF THE INVENTION

1. Field of the Invention

The present invention relates to a dose monitor chamber for radiation. In particular, this invention relates to a dose monitor chamber for electrons or X-rays, preferably for use in or in conjunction with a linear accelerator.

2. Description of the Prior Art

U.S. Pat. No. 4,131,799 discloses a dose monitor chamber or ionization chamber which is employed to monitor the radiation exiting from a particle accelerator. Of interest is not only the totally emitted radiation intensity but also the (uniform or irregular) distribution of the radiation within the emitted radiation cone. The known monitor chamber detects all kinds of nonhomogeneities of the dose rate. In particular, it is applicable for determining asymmetries as well as changes of electron or X-ray distribution. The ionization chamber according to the prior art comprises essentially a first electrode arrangement in a first plane and a second electrode arrangement located in a second plane parallel to the first plane. The first arrangement contains a round central plate which functions as an electrode and which is surrounded by four further plates. These plates are insulated from each other and are symmetrically arranged with respect to the central plate. They also serve as electrodes. The ionization chamber further comprises a spacing ring for keeping the second arrangement of electrodes in a plane parallel to the first arrangement, thereby forming a first chamber. The second electrode arrangement is a round plate which is supplied by a high voltage. The current derived from the individual measuring electrodes is proportional to the dose rate received in the corresponding measuring volume. To the ionization chamber is connected a second chamber, where the totally received dose rate is measured.

In such a dose monitor chamber having a multi-electrode system the problem arises that a plurality of electric signals must be conducted out of the chamber(s) without electrical interference and then must be processed. This means that a comparatively large number of preamplifiers and of subsequent electronic components is necessary. Furthermore, cables and insulated boxes or openings for the electric wires are required in corresponding number. It is apparent that such a dose monitor chamber having a multi-electrode system is expensive and presents a complicated mechanical construction.

SUMMARY OF THE INVENTION

1. Objects

It is an object of this invention to provide a dose monitor chamber for the identification of signal asymmetries and nonhomogeneities, such monitor chamber having a high resolution and a simple design.

It is another object of this invention to provide a dose monitor chamber wherein the number of electronic components which are necessary to determine a signal indicative of radiation asymmetry and/or a signal indicative of radiation nonhomogeneity is reduced.

It is still another object of this invention to provide a dose monitor chamber wherein the number of terminals connected to the measuring electrodes and leading out of the chamber is reduced.

It is still another object of this invention to provide a dose monitor chamber for electrons or X-rays, wherein relatively large individual signals can be obtained from the individual measuring electrodes so that the signal-to-noise relationship is reduced.

2. Summary

According to the invention a dose monitor chamber comprises a first and a second measuring electrode. The first measuring electrode is essentially a first ring portion which at its circumference extends from 0° to approximately 180°, in particular a little less than 180° or a little more than 180°. The second measuring electrode is located in the same plane as the first measuring electrode. It comprises a full inner circular area to the periphery of which a second ring portion adjoins in an electrically conducting manner. The first ring portion and the second ring portion are electrically separated from one another at their facing ends. Similarly, the inner rim of the first ring portion is electrically separated from the rim of the inner circular area. In other words, the measuring electrodes are electrically insulated from each other by a given distance. The construction is such that the first and the second ring portion combined are approximately 360°.

The measuring electrodes are preferably thin electrically conductive layers affixed to an insulating material.

With such a dose monitor chamber two electrical signals can be obtained. One signal is detected by the first measuring electrode, and the other signal is detected by the second measuring electrode.

For the purpose of producing a symmetry signal, both electrode signals are weighted and then compared with each other in a comparator. If radiator symmetry prevails, the weighted electrode signals will be equal.

In order to obtain a flatness signal there is the following possibility: The sum of both electrode signals as well as their weighted difference are formed. In a comparator (e.g. difference amplifier) the sum signal and the difference signal are compared to each other. The output signal of this comparator yields information about the radiation homogeneity and can thus be addressed as a substantially flat or homogeneity signal. A change of the homogeneity signal indicates a change of the radiation homogeneity. In most cases it is also an indication that the energy of the linear accelerator has changed. When there is homogeneity, the weighted input signals of the comparator are equal.

It is especially advantageous when each of the areas of the first and of the second ring portion is half the area of the inner circular area. Consequently, in case of symmetry and homogeneity, one electrode signal is smaller than the other by a factor of 3. This imbalance can be adjusted by weighting during the processing of the signals.

According to further embodiments, the first ring portion of the first measuring electrode may extend from 0° to approximately 160°, i.e. a little less than 180°, or it may extend from 0° to approximately 200°, i.e. a little more than 180°. Thus, also asymmetries can be detected in a radial axis which passes along the facing edges of both ring portions. In designs actually implemented values of 157.5° and 202.5°, respectively, have been applied.

As in the prior art, the distance between the first and the second measuring electrodes is chosen in accordance with the applied voltage and with the insulating ability of the applied insulating material.

In comparison with the ionization chamber available in the prior art (U.S. Pat. No. 4,131,799), the following advantages have been achieved: The individual signals derived from the individual measuring electrodes are larger owing to the larger areas of the measuring electrodes. The signal resolution, however, remains the same. Furthermore, only two measuring electrodes are required, and only two signal channels are necessary for processing the electrode signals derived therefrom. As a result there is a significant reduction of terminals, connection leads and components. Thus, the construction of an ionization chamber according to this invention is simplified thereby reducing costs of production.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Figure 1:
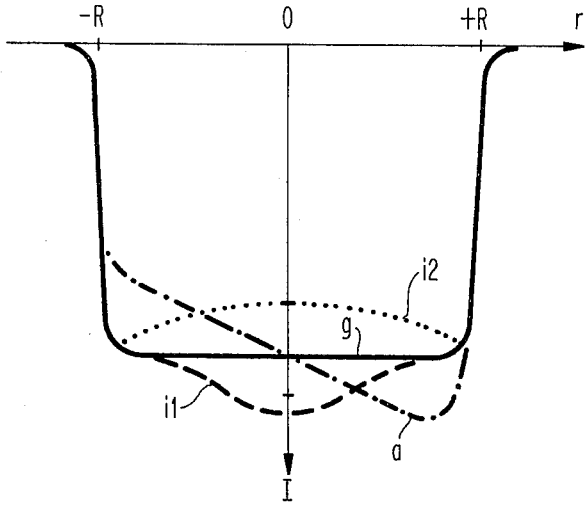
FIG. 1 is a diagram of an even and several uneven intensity distributions of radiation of a linear accelerator.

With reference to FIG. 1, the distribution of the radiation intensity or dose rate I is plotted in a direction r across to the central beam of a linear accelerator. The radiation can be electron or X-ray radiation. The location +R and −R indicate the points of the strongest rise of intensity I and concurrently roughly the radius of the ionization chamber illustrated in FIG. 2.

In the adjusted state of the linear accelerator a regular or even distribution of intensity I is attained, which is represented by the curve g in FIG. 1. In all other cases an uneven or irregular distribution of intensity I is obtained. The curve a shows, for instance, an asymmetrical distribution. In this curve a the intensities in the outer areas, that is close to the locations +R, −R, are of differing size. As a further example, the curve i1 shows a nonhomogeneous intensity distribution whereby a certain symmetry prevails and whereby the intensity in the region of the central beam (r=0) is higher than in the outer regions (+R, −R). In contrast thereto, the curve i2 shows a nonhomogeneity, whereby the intensity in the region of the central beam (r=0) is smaller than in the outer regions (+R, −R). Here again the distribution of the intensity I is symmetrical with respect to the central beam at r=0.

In a linear accelerator there may occur still other irregular curve patterns, (that is, patterns deviating from the curve g), especially mixed forms of the curves a, i1 and i2. In a linear accelerator it is of primary concern to determine deviations from the curve g with respect to symmetry and flatness quickly and effectively and subsequently to introduce countermeasures. With the ionization chamber shown in FIGS. 2–4 asymmetries and nonhomogeneities in the radiation of a linear accelerator can be detected quickly, accurately and easily.

Figure 2:
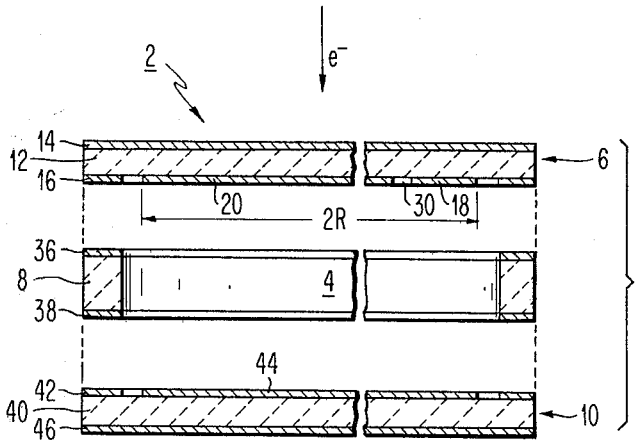
FIG. 2 is a cross-sectional exploded view of an ionization chamber according to the invention.
Figure 3:
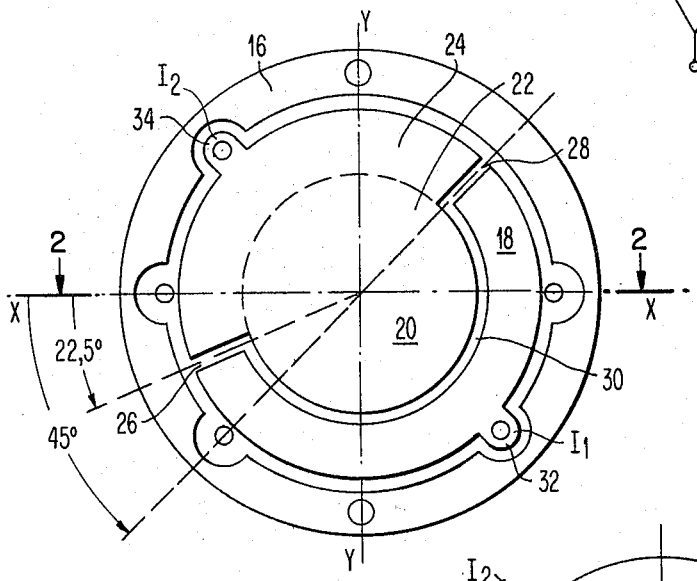
FIG. 3 is a plan view of a two-electrode arrangement in an ionization chamber according to the invention.

According to FIGS. 2 and 3 the measuring space 4 of an ionization chamber 2 is essentially formed by a first electrode plate 6, a spacing ring 8 and a second electrode plate 10. The first electrode plate 6 contains a first circular insulating plate 12 which is provided on its upper side with an electrically conductive layer 14 that is electrically grounded. The first insulating plate 12 can be either a ceramic plate or a plastic foil. A ceramic plate is preferably applicable for X-ray radiation monitoring, and a synthetic foil is preferred for monitoring or measuring electrons. The lower side of the first insulating plate 12 is provided on its outer rim with an auxiliary electrode which acts as a protective ring 16 and which is also grounded. In the middle region of the lower side of this first insulating plate 12 there is located a two-electrode arrangement. As shown in detail in FIG. 3, two flat measuring electrodes 18 and 20 are applied here to the insulator plate 12, for instance, by evaporation. They are both located in the same plane.

The two-electrode arrangement 18,20 has a characteristic design. The first measuring electrode 18 is essentially a first ring portion which extends from one face end to the other from 0° to 202.5°. The second measuring electrode 20 consists of a somewhat more complex structure. One can visualize that this second measuring electrode 20 encompasses a full inner circular area 22 (indicated by broken lines), which is surrounded by a second ring portion 24. Both ring portions 18 and 24 have the same inner and outer radius. At both its ends the second ring portion 24 is electrically separated from the ends of the first ring portion 18 by a nonconductive gap or separating groove 26 and 28, respectively. Similarly there is an electrical separation 30 between the rim or circumferential edges of the inner circular area 22 and the inner edge of the first ring portion 18. All the separations or grooves 26, 28 and 30 preferably have the same width which may be between 1 an 2 mm. The width depends on the voltage applied.

Both outer ring portions 18, 24 combined peripherally extend over approximately 360°. The area of the circular disk 22 is preferably approximately as large as the area of the first and second ring portions 18 or 24 combined.

From both electrodes 18 and 20 electrode signals I1 and I2 respectively, are derived. For this purpose terminals or contact fingers 32 and 34 are provided. The connecting leads are led out perpendicular to the plane of the surfaces 18, 20, 24, etc. The two-electrode arrangement 18, 20 is surrounded by the protecting ring 16. Openings and recesses serve to guide the connection leads. The outer circumference of both electrodes 18 and 20 is approximately equal in size to the outer circumference of the radiation cone at the place of the ionization chamber.

Referring to the exploded view of FIG. 2 the spacing ring 8 will be attached to the lower side of the first electrode plate 6. On its upper and its lower side the spacing ring 8 has an electrically conducting outer ring surface 36, 38, respectively. These rings 36 and 38 are also grounded.

The second electrode plate 10 contains a second circular insulating plate 40, which may be made of the same insulating material as the first insulating plate 12. The plates 12, 40 are parallel to each other. The second insulating plate 40 supports on its upper side an electrically conductive outer circular ring 42. This ring 42 is electrically grounded. In the central portion of the upper side is located a circular disk-shaped high voltage electrode 44. This electrode 44 is provided with a voltage (measured against ground) which can be between 300 and 1000 volts. Thus, the high voltage electrode 44 and the first measuring electrode 18 form a first capacitor whose dielectric is determined by the gas located in the space between them. At the same time the high voltage electrode 44 and the second measuring electrode 20 form a second capacitor whose dielectric is likewise determined by the gas in the space between them. These capacitors constitute two individual ionization chambers. The underside or lower end face of the second insulating plate 40 is completely covered with an electrically conducting layer 46 which is grounded.

All the electrodes and conducting areas referenced above can preferably be made by vaporized thin layers out of an electrically conductive material. For X-ray radiation nonconductors 12, 40 of aluminium oxide lines with silver electrodes may preferably be used. These two materials aluminum oxide and silver afford an airtight encapsulation or sealing of the measuring space 4. For electrons a synthetic or plastic film or foil nonconductors 12, 40 lined with gold electrodes may preferably be used. With these substances generally an airtight sealing is hard to achieve.

It should also be determined that the ionization chamber thus far described can be associated with or connected to a second chamber which measures the total average dose rate.

Figure 4:
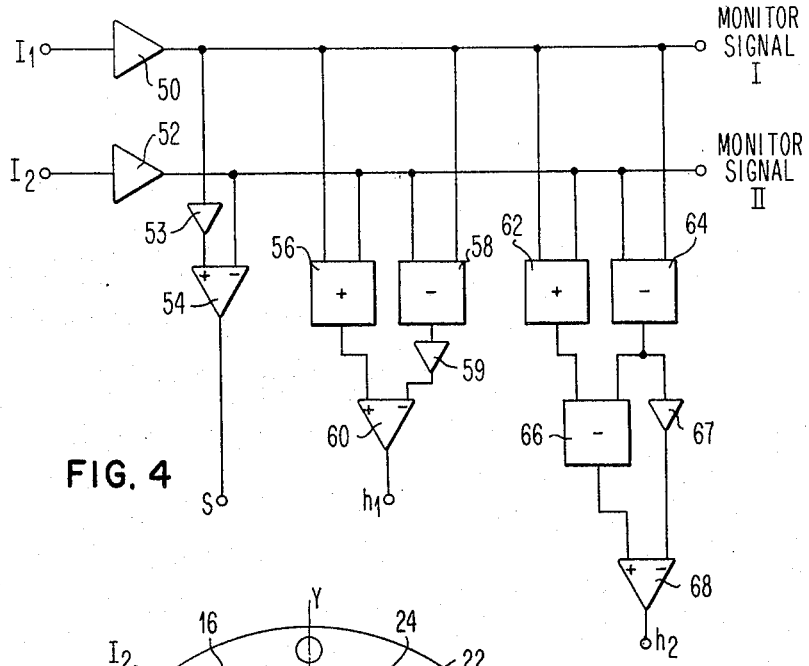
FIG. 4 is a processing circuitry for the electrode signal derived from the two-electrode arrangement.

For a determination of symmetry and/or flatness the charge flowing from both measurement electrodes 18, 20 to ground is being measured. This produces the two electrode signals I1 and I2 mentioned previously. In FIG. 4 are shown embodiments of evaluation circuits for processing both electrode signals I1 and I2.

According to FIG. 4 both electrode signals I1 and I2 are fed into preamplifiers 50 and 52, respectively. The preamplified signals may be passed on as Monitor Signal I and Monitor Signal II, respectively, for further processing in well known manner. The amplification factors of the preamplifiers 50 and 52 are assumed to be the same.

The preamplified signal I1 is fed into an adjustable amplifier 53. The amplifier 53 serves for adjusting or weighting purposes such that in case of symmetry its output signal is as large as the preamplified signal I2. If the area of the measuring electrode 18 is approximately one third the area of the measuring electrode 20, the amplification factor to be chosen should be approximately 3. Both preamplified signals are sent to a comparator 54, for instance, a difference amplifier. This comparator 54 compares the size of its two input signals. Generally this can be a difference amplifier that reacts only after a threshold has been exceeded. At the output of the comparator 54 a symmetry signal s is emitted. If symmetry prevails and if the two input signals are equal due to electronic balancing in the amplifier 53, the symmetry signal s will be zero. If symmetry no longer prevails, the symmetry signal s will be different from zero.

With reference to FIG. 4, there are two ways of producing a flatness signal h1 or h2.

According to the first method of producing a flatness signal h1, both electrode signals I1 and I2 are fed into a summing or adding member 56 as well as into a subtractor or subtracting member 58. Connected to the output of the subtracting member 58 is an adjusting or weighting amplifier 59. The summation signal (I1+I2) and the weighting difference signal (I1−I2) will be equal to each other in case of homogeneity or flatness. Both signals are passed into another comparator 60. This comparator 60 can also be a difference amplifier to which is assigned a threshold. From the output of this comparator 60 the flatness signal h1 is derived.

According to the second method of producing the flatness signal h2 a summation signal (I1+I2) and a difference signal (I1−I2) are formed in a summation and a subtraction device 62 and 64, respectively. Subsequently these signals (I1+I2) and (I1−I2) are subtracted from each other in a subtractor 66. The result corresponds to the signal of the total outer ring 18, 24. It is passed on to a comparator 68. The difference signal (I1−I2) corresponds to the signal of the inner circular area 22. This difference signal (I1−I2) is fed into an adjusting amplifier 67 for weighting. The output signal of the adjusting amplifier 67 is likewise fed into the comparator 68. At the output of the comparator 68 the flatness signal h2 is produced. If a homogeneous intensity distribution prevails and if both input signals are equal to each other, it will be zero.

The second method (signal h2) produces better resolution for detecting homogeneity differences than does the first method (signal h1).

It has already been mentioned that as illustrated in FIG. 4 the output signal of the preamplifier 50 is fed into an adjustable amplifier 53. This adjustable amplifier 53 serves to adjust its output signal so that when symmetry occurs this output signal is as large as the output signal of the preamplifier 52. Under the assumption that the inner circular plate 22 is approximately the same size as the area of the complete outer ring 18, 24, then when symmetry occurs, the signal I1 will be approximately one third the size of the signal I2. This means that the amplifier 53 has to amplify the output signal of the preamplifier 50 by approximately a factor of 3 so that its output signal is approximately the same as the output signal of the preamplifier 52.

First it will be assumed that the symmetrical intensity distribution g shown in FIG. 1 prevails along the line X—X in FIG. 3. In this case the second measuring electrode 20 issues a measuring signal I2 that is approximately three times as large as the measuring signal I1 of the first measuring electrode 18. As a result of the selected adjustment of the preamplifier 53, both input signals of the comparator 54 are the same size, and the output signal S of the comparator 54 is zero.

Now it is assumed that the symmetrical intensity distribution a shown in FIG. 1 prevails along the line X—X in FIG. 3. In this case the second electrode 20 will produce a smaller measuring signal I2 as compared with the symmetrical case of the curve g. The first electrode 18, however, will produce a larger measuring signal I1 as compared with the symmetrical case of the curve g. This is due to the increased intensity in the right area close to the location +R. This means that the signals at the input of the comparator 54 are no longer equal. The input signal at the positive input of the comparator 54 prevails. Therefore, the symmetry signal s no longer equals zero; it becomes a positive value.

The same result will be obtained when the asymmetrical curve a as a whole is larger or smaller than the symmetrical curve g. It is evident that only the intensity difference between the left rim region (−R) and the right rim region (+R) is of any importance.

Next it is assumed that the asymmetrical intensity distribution of the curve a in FIG. 1 prevails along the line Y—Y in FIG. 3, whereby the rim region of stronger intensity (right rim as illustrated) lies on the second measuring electrode 20. In this case the first measuring electrode 18 provides a smaller output signal I1 as compared with the symmetrical case of curve g, while the second measuring electrode 20 produces a larger output signal I2. In this case, therefore, the input signal at the negative input of the comparator 54 is larger than the input signal at the positive input. Consequently, the symmetry signal a is now negative. The polarity (+ or − sign) of the symmetry signal s indicates in which direction an asymmetry prevails.

It has already been mentioned that in case of homogeneous intensity distribution, at the inputs of the comparator 60 signals of equal size prevail.

First it will be assumed that the nonhomogeneous signal i1 of FIG. 1 prevails along the line X—X in FIG. 3. In this case the circular disk 22 (area factor 2) receives a larger intensity than the first ring portion 18 (area factor 1) and the second ring portion 24. Consequently the measuring signal I2 has increased with respect to the measuring signal I1 of the first electrode 18 when compared to the case of uniform distribution of intensity g. Consequently percentage of the output signal of the amplifier 59 has gained with respect to the output signal of the addition element 56. At the inputs of the comparator 60 the input signal which has been delivered by the adjustable amplifier 59 will prevail so that there results a negative flatness signal h1. This is an indication that the X-ray radiation cone or the electron beam of the linear accelerator is no longer homogeneous.

If, however, the nonhomogeneous curve i2 prevails along the X—X axis, then a positive flatness signal h1 will be produced in correspondence with the reasons mentioned above.

In the case of homogeneity or flatness (curve g in FIG. 1) the second measuring signal I2 is here again larger than the first measuring signal I1 by a factor of 3. The addition of both signals I1, I2 in the addition element 62 produces a corresponding sum signal (I1+I2), while the subtraction in the subtractor 64 produces a corresponding difference signal (I2−I1). The output signals of the components 66 and 67 are equal to each other. This is determined by the comparator 68.

Now it is assumed that the nonhomogeneous curve i1 of FIG. 1 prevails along the line X—X in FIG. 2. In contrast to the homogeneous case of the curve g, the second measuring signal I2 has become larger in relation to the first measuring signal I1. The output signal of the subtractor 66 remains unchanged. Yet the output signal of the amplifier 67 has increased. Thus a negative flatness signal h2 is delivered by the comparator 68.

In like manner a positive flatness signal h2 is produced when the intensity curve i2 prevails along the line X—X in FIG. 3.

Figure 5:
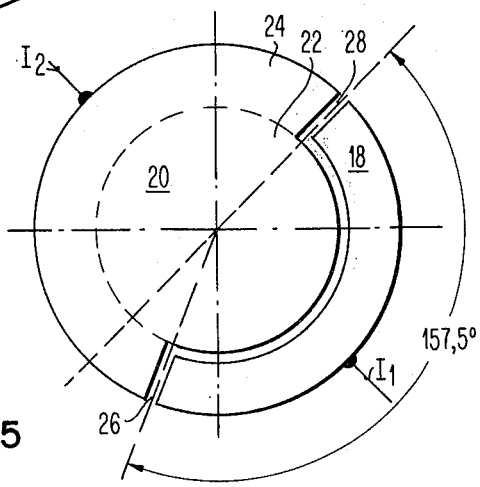
FIG. 5 is a plan view of another two-electrode arrangement according to the invention.

In FIG. 5 an embodiment of the two-electrode arrangement is shown in which the first ring portion 18 is shorter along its periphery than the second ring portion 24. In this case also both ring portions 18, 24 combined extend to an angle of approximately 360°. In particular, the sector of the first ring electrode 18 covers approximately 180°. In the illustrated example an angle of 157.5° was chosen. Thus, two radially extending separation grooves 26, 28 are located at 0° and 157.5°, respectively. The function of this two-electrode arrangement is similar to that of FIG. 3.

While the forms of the dose monitor chamber for electron or X-ray radiation herein described constitute preferred embodiments of the invention, it is to be understood that the invention is not limited to these precise forms of assembly, and that a variety of changes may be made therein without departing from the scope of the invention.

What is claimed is:

1. A dose monitor chamber for X-rays or electrons, comprising in combination:

(a) a first electrode which is formed as a portion of a first flat ring, said first electrode being arranged in a first plane;

(b) a second electrode which is formed as a flat circular disk contacting along its periphery the periphery of a portion of a second flat ring, said second electrode being arranged in said first plane at a distance from said first electrode, whereby said portion of said first ring and said portion of said second ring extend together over approximately 360°; and (c) a third electrode arranged in a second plane parallel to and spaced from said first plane.

2. The dose monitor chamber according to claim 1, wherein the area of said circular disk is approximately as large as the area of said first and of said second ring portion combined.

3. The dose monitor chamber according to claim 1, wherein said portion of said first ring extends peripherally over a sector of more than 180°.

4. The dose monitor chamber according to claim 3, wherein said portion of said first ring extends over a sector of more than 200°.

5. The dose monitor chamber according to claim 3, wherein said first and said second electrode form two radially extending separation grooves, which are located circumferentially at 0° and 202.5°, respectively.

6. The dose monitor chamber according to claim 1, wherein the distance between said first and said second electrode is equidistant.

7. The dose monitor chamber according to claim 6, wherein said distance between said electrodes has a value which is between 1 and 2 mm.

8. The dose monitor chamber according to claim 1, wherein said portion of said first ring extends peripherally over a sector of less than 180°.

9. The dose monitor chamber according to claim 8, wherein said first ring portion extends over a sector of less than 160°.

* * * * *